US006412124B1

(12) United States Patent
Anderson

(10) Patent No.: US 6,412,124 B1
(45) Date of Patent: Jul. 2, 2002

(54) AUTOMATIC DEPLOYING MULTI-PANELED SHOWER CURTAIN

(76) Inventor: James P Anderson, 157 N. Woodlawn Ave., Avon Park, FL (US) 33825

( * ) Notice: Subject to any disclaimer, the term of this patent is extended or adjusted under 35 U.S.C. 154(b) by 0 days.

(21) Appl. No.: 09/718,005

(22) Filed: Nov. 21, 2000

(51) Int. Cl.[7] ..... A47K 3/36

(52) U.S. Cl. ..... 4/557; 4/607; 160/172; 160/199; 160/900

(58) Field of Search ..... 4/607, 610, 557; 160/169, 172 R, 185, 199, 206, 214, 900, DIG. 6

(56) References Cited

U.S. PATENT DOCUMENTS 2,614,627 A * 10/1952 Miller ..... 160/199
2,635,686 A * 4/1953 King ..... 160/172 R
2,756,817 A * 7/1956 Toti ..... 160/900 X
3,167,111 A * 1/1965 Harris ..... 160/199 X
3,473,597 A * 10/1969 Chevaux ..... 160/172 R

* cited by examiner

*Primary Examiner*—Robert M. Fetsuga

(57) ABSTRACT

A shower curtain is formed of a plurality of hanging panels which are attached to a track member for automatic deployment between a retracted, or drying, arrangement and an extended, or barrier, arrangement. Each panel has an ogee, or 'S', shape. A plurality of sliding portions, with a panel attached thereto, engage the track member for displacement therealong. Two connectors couple each adjacent pair of sliding portions to provide the desired automatic rotation to the sliding portions and the panels attached thereto. One of these connectors is fixedly positioned relative to one of the pair of sliding portions to convey rotational movement thereto. The second of these connectors is pivotally positioned relative to the second of the pair of sliding portions. The connectors are pivotally coupled together distal from their respective coupling to the respective sliding portions.

9 Claims, 4 Drawing Sheets

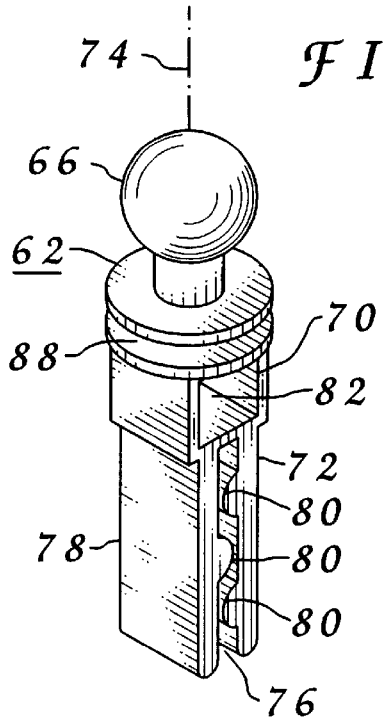
FIG. 3
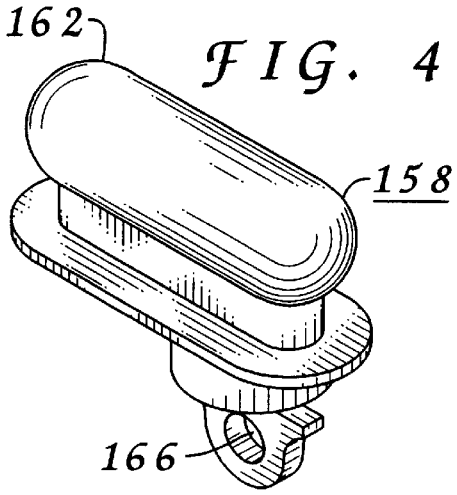
FIG. 4
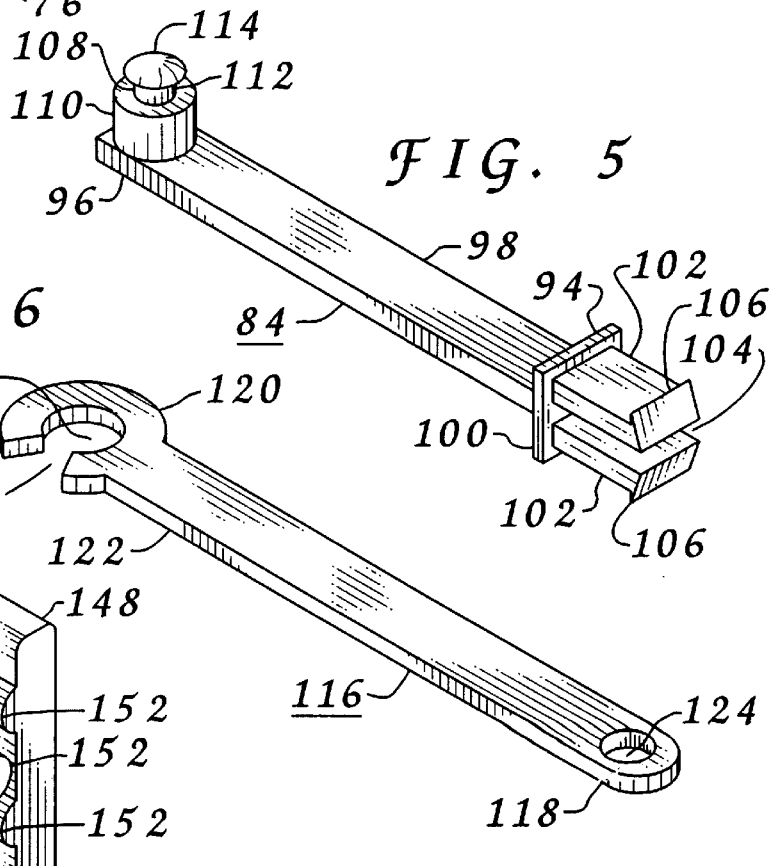
FIG. 5
FIG. 6
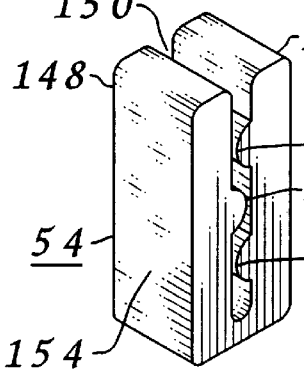
FIG. 7

AUTOMATIC DEPLOYING MULTI-PANELED SHOWER CURTAIN

BACKGROUND

1. Field of the Invention

Generally, the invention relates to an assembly which hangedly supports panels along a track member while providing for rotational displacement of the panels in response to a select movement of the assembly along the track member for automatic deployment of an automatic deploying multi paneled shower curtain along the track member.

2. Description of the Prior Art

Shower curtains and partitioning doors are the most commonly used methods for preventing the escape of a spray of water from a showering area during use. Each has a closed, or extended, position, and an opened, or retracted, position. The closed position covers the opening or entryway while the opened position leaves the entryway unobstructed.

Generally conventional shower curtains are attached to a rod located along the upper region of the entryway and the shower curtain is extended along this rod and across the opening during use. Following the showering procedure, the shower curtain is either extended across the opening or left retracted to one end of the rod.

Generally partitioning doors are either used singularly or in sets of two doors. When used singularly they are routinely hinged on one side. When used in sets they are routinely mounted to slide in opposing upper and lower tracks. In this sliding configuration each of the doors normally have horizontally spaced upper slide members which engage within the upper tracks. Without regard for the number of partitioning doors used it is conventionally known to provide a radially surrounding frame assembly about the door or doors. This arrangement is less attractive than desired and has the tendency to be difficult to clean. Additionally, the lower extent of the frame assembly must be crossed to enter and exit the showering area presenting a danger to the user.

Following the showering procedure, when either the shower curtain or the partitioning doors are left in the closed position, the flow of air is restricted to the then wet showering area. This promotes a damp condition within the showering area which promotes the growth of molds and funguses. When either the shower curtain or the sliding partitioning doors are left in the open position, partially enclosed areas result which retain the moisture gathered in these sections. This similarly promoting the growth of molds and funguses upon the shower curtain or partitioning door.

Applicant's prior U.S. Pat. No. 5,448,786 disclosed a multi paneled shower curtain which utilized a complicated extension, retraction and rotation mechanism. While this unit has been in production for a long time, the present invention significantly reduces manufacturing costs while providing for fool proof operation.

For the foregoing reasons, it may be appreciated that there continues to be a need for an automatically deploying multi paneled shower curtain which is attractive, functional, safe and provides for adequate ventilation following the showering procedure to reduce the growth of molds and funguses. The present invention substantially fulfills these needs.

SUMMARY

In view of the foregoing disadvantages inherent in the known types of shower curtains, your applicant has devised a method of automatically deploying a multi paneled shower curtain in response to movement of assemblies, having the panels attached thereto, along a track member. An automatic deploying multi panel shower curtain has a water resistant barrier orientation and a ventilated drying orientation. The automatic deploying multi panel shower curtain comprise a track member, a plurality of panel connectors, a plurality of panels, a plurality of first pivotal connections, a plurality of second pivotal connections and means to provide for a cooperation to provide for transfer of the automatic deploying multi panel curtain between the water resistant barrier orientation and the ventilated drying orientation. The track member provides for a sliding retention of moveable portions of the automatic deploying multi panel shower curtain. Each of the panel connectors slidably engages the track member and has a vertical axis relative to the track member. The panels provide for forming the water resistant barrier orientation while deployed in an extended arrangement along the track member and to provide for forming the ventilated drying orientation while deployed in a retracted arrangement along the track member. Each panel is hangedly connected to a respective panel connector. Each first pivotal connection provides for a pivotal connection which occurs in close proximity to the vertical axis of a respective retained panel. Each second pivotal connection provides for a pivotal connection which occurs offset from the vertical axis of a respective retained panel. The means for cooperation provides for a cooperation between respective cooperating sets of panel connector, first pivotal connection and second pivotal connection. The cooperation provides for transfer of the automatic deploying multi panel shower curtain between the water resistant barrier orientation and the ventilated drying orientation.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for an automatic deployment of the multi panel shower curtain during expansion and retraction of the multi panel shower curtain.

Other objects include;

a) to provide for a single user action to manipulate the automatic deploying multi panel shower curtain during the expansion procedure resulting in the automatic deploying multi panel shower curtain being in the expanded water barrier orientation at a conclusion of the user action.

b) to provide for a single user action to manipulate the automatic deploying multi panel shower curtain during the retraction procedure resulting in the automatic deploying multi panel shower curtain being in the retracted drying orientation at a conclusion of the user action.

c) to provide for a pivotal connection in close proximity to a vertical axis of a panel connector.

d) to provide for an extension member and a coupling member linked at a pivotal connection which moves this pivotal connection spaced away from the vertical axis of a panel connector.

e) to provide for placing the spaced away pivotal connection fixed relative to a first panel.

f) to provide for placing the spaced away pivotal connection pivotal relative to a second panel.

g) to provide for ogee, 'S', shaped panels wherein an overlapping arrangement provides for a strong water resistant barrier while in the deployed orientation which is resistant to passage of water during a showing procedure.

h) to provide for an automatic deploying multi panel shower curtain which does not require a lower track member at the lower opening of the showering area.

i) to provide for an automatic deploying multi panel shower curtain which does not require side members at the opening of the showering area.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 3 is a perspective view of a sliding member.

FIG. 4 is a perspective view of a control rod sliding member.

FIG. 5 is a perspective view of a protrusion member.

FIG. 6 is a perspective view of an extension member.

FIG. 7 is a perspective view of a spacer member.

DESCRIPTION

Figure 1:
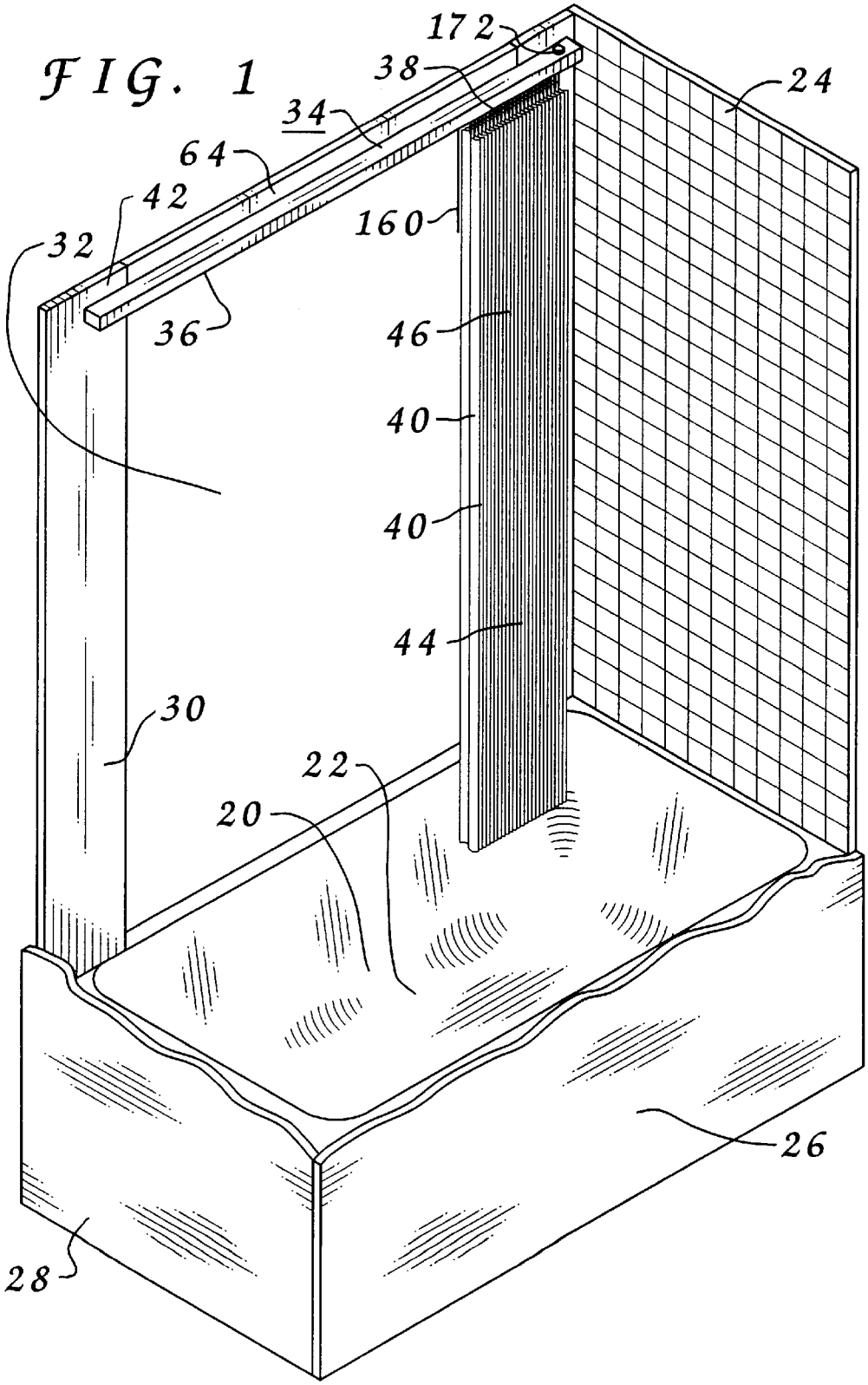
FIG. 1 is a perspective view of a tub assembly, with a side and rear wall cut away, with a multi paneled shower curtain install at an opening thereof.

Reference is now made to the drawings where like reference numerals refer to like parts throughout the various views. A shower area 20 partially defined by a tub 22, a first side wall 24, a rear wall 26 (shown partially cutaway), a second side wall 28 (shown partially cutaway) and a forward wall 30 having an opening 32 therein, is depicted in FIG. 1.

It being understood that many showering areas do not include the front wall and it's presence is not required to practice the invention. In existing locations where only the tub or shower pan and opposing side walls are present, the front wall can be optionally installed to prevent leakage of water around the ends of the multi-paneled shower curtain. In any of the installations attachment can be accommodated in any of the conventional methods for installing a current use shower curtain rod, such as to the opposing side walls or to the ceiling.

Overview

It is a desire to provide an automatic deploying multi panel shower curtain where each panel is automatically deploying from a drying orientation to a barrier orientation during transfer of the automatic deploying multi panel shower curtain from a retracted arrangement to an extended arrangement and automatically deploying from the barrier orientation to the drying orientation during transfer of the automatic deploying multi panel shower curtain from the extended arrangement to the retracted arrangement. Preferably the panels of the automatic deploying multi panel shower curtain will be ogee, or 'S', shaped to provide for a true overlapping placement while the panels are in the barrier orientation.

An automatic deploying multi panel shower curtain 34 having a track member 36, a plurality of assemblies 38 and a plurality of panels 40 is depicted positioned at an upper extent 42 of forward wall 30. Each panel 40 of automatic deploying multi panel shower curtain 34 is depicted in a drying orientation 44 while the overall automatic deploying multi panel shower curtain 34 is depicted in a retracted arrangement 46. This allows passage of a person, not shown in any of the views, through opening 32. While panels 40 are in drying orientation 44, see FIG. 1 and FIG. 11, which forms retracted arrangement 46, each adjacent pair of panels 40 have a spacing 48, see FIG. 11, therebetween which affords complete drying of water from panels 40 following a showering procedure. As more fully disclosed elsewhere herein, panels 40 are transferred between drying orientation 44 and a barrier orientation 50, see FIG. 2 and FIG. 10, which forms an extended arrangement 52, simple by extending the curtain along track member 36 or simply by retracting the curtain along track member 36.

Figure 2:
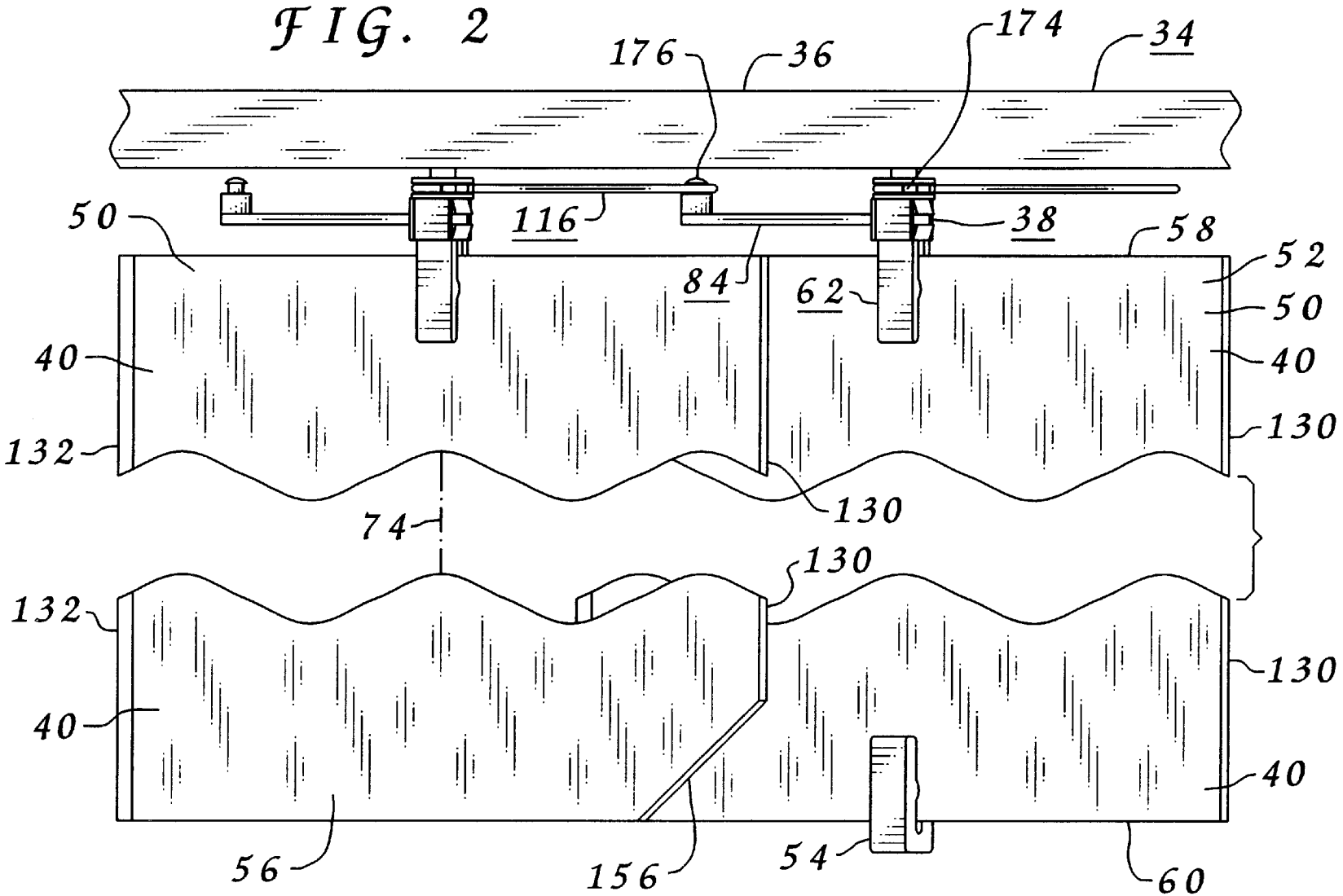
FIG. 2 is an elevational view of a portion of an automatic deploying multi panel shower curtain.

FIG. 2 depicts a portion of automatic deploying multi panel shower curtain 34 showing track member 36, one (1) complete assembly 38, two (2) panels 40 and a spacer member 54. As clearly depicted in FIG. 10, each adjacent pair of panels 40 overlap to form a water resistant barrier 56. Each panel 40, see FIG. 2, has an upper extent 58 and a lower extent 60. Each upper extent 58 of a respective panel 40 attaches to a sliding member 62. In order to ensure that adjacent sets of panels 40 do not become attached together by moisture thereon, one (1) spacer member 54 having a predetermined thickness on each hemisphere is positioned on every other panel 40 at lower extent 60 to prevent contact of adjacent panels 40 while in drying orientation 44. Alternatively, a spacer member extending outward on only one side may be attached to each panel 40 to perform the same function.

Components

Various configurations of assemblies, and components thereof, may be utilized to provide for the desired automatic rotation of the panels during the extension and retraction procedures. Preferably, such rotation will provide for each panel to rotate approximately one quarter turn, approximately ninety (90) degrees, between the drying orientation and the barrier orientation. The examples which follow provide for this approximately one quarter turn rotation for each panel in succession during both directions of displacement. It is a desire that components be provided to slidably engage the track member, engage the panel to hang relative to the track member, provide for fixed extension of a pivotal point relative to a pivotal axis of the panel and provide for connection of the fixed pivotal point to a pivotal connection of a detached member which may be a fixed anchor point, an adjacent panel set or a control rod sliding member. The component examples which follow provide for satisfying these functions. Numerous other components may be utilized to fulfill the above defined desires. Various components may be provided which perform one of the above defined desires. Alternatively, various components may be provided which perform two or more of the above defined desires. Numerous combinations are possible.

FIG. 1 and FIG. 2 depict track member 36 capable of being attached in close proximity to opening 32 at an upper extent 64, see FIG. 1. Track member 36, as conventionally known in the art, may be of numerous configurations and may slidably engage other components of the present invention. The track member has been removed from all subsequent top plan views to more fully expose the components attached there beneath and their operations.

Figure 8:
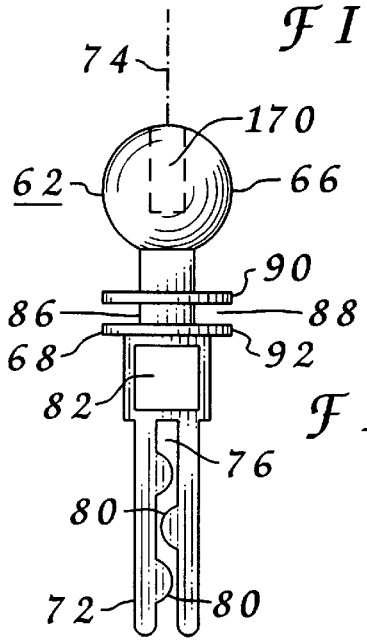
FIG. 8 is an elevational view of the sliding member depicted in FIG. 3.

FIG. 2, FIG. 3 and FIG. 8 depict sliding member 62 which is capable of being molded from a plastic and which performs several functions of the present invention. In this embodiment sliding member 62 further comprises a sliding portion 66, a pivotal coupling portion 68, a fixed mounting portion 70 and a panel coupling portion 72. Sliding portion 66 positioned at an upper extent of sliding member 62 provides for retention of sliding member 62 within track member 36 while allowing for controlled movement of sliding member 62 along track member 36. A rotational axis 74 extends vertically through sliding member 62 about which rotation may occur relative to track member 36, see FIG. 1 and FIG. 2. Panel coupling portion 72, positioned at a lower extent and distal from sliding portion 66 on sliding member 62, has a panel channel 76 bounded by legs 78. Each leg 78 has extending inward at panel channel 76 at least one (1) panel locking ridge 80. Any panel locking ridges 80 ideally are offset elevationally one to the other. One (1) panel 40 is inserted within panel channel 76 and is retained therein by a binding pressure applied by panel locking ridges 80. This preferred arrangement of panel locking ridges 80 provides for easy removal of panels 40 for cleaning and, if required, replacement. This preferred arrangement also provides for a safety release of the respective panel(s) 40 without damage being inflicted on any structural component of automatic deploying multi panel shower curtain 34. This safety release provides for each panel 40 to be released from there respective sliding member 62 in the advent that a person grasps and inadvertently applies a pressure to the panel 40 as exampled by during slipping or otherwise stumbling into the shower curtain. Fixed mounting portion 70 further comprises a protrusion mounting channel 82 which penetrates sliding member 62 aligned with panel channel 76. Protrusion mounting channel 82 provides for a fixed attachment of a protrusion member 84, see FIG. 5, more fully disclosed elsewhere herein. Pivotal coupling portion 68 further comprises an extension mounting shaft 86, see FIG. 8, which is aligned with rotational axis 74 within an extension mounting channel 88. Extension mounting channel 88 is bounded by an upper guide 90 and a lower guide 92.

FIG. 2 and FIG. 5 depict protrusion member 84 which is capable of being molded from a plastic and which is fixedly attachable to sliding member 62. Protrusion member 84 has a fixed coupling portion 94 at one end, a pivotal coupling portion 96 at the opposing end and an extending portion 98 positioned therebetween. Fixed coupling portion 94 of protrusion member 84 provides for anchoring of protrusion member 84 relative to fixed mounting portion 70 of sliding member 62. Fixed coupling portion 94 further comprises an abutment plate 100 and opposing prongs 102 extending therefrom generally aligned with extending portion 98. Prongs 102 are separated by a compression slot 104. Each prong 102 further has a locking ridge 106 at an end thereof and extending outward from compression slot 104. Prongs 102 between abutment plate 100 and locking ridges 106 have a shape and size generally matching protrusion mounting channel 82 of sliding member 62 for insertion therein. Compression slot 104 allows prongs 102 to deflect inward during insertion while locking ridges 106 to provide for retention of protrusion member 84 relative to sliding member 62. It is a desire that a pivotal coupling 108 of pivotal coupling portion 96 be generally align with extension mounting channel 88 of sliding member 62 while protrusion member 84 is attached to sliding member 62. To this end pivotal coupling portion 96 has an elevation portion 110 to elevate pivotal coupling 108. Alternatively, an angular incline may be provided to extending portion 98. Pivotal coupling 108 further comprises an extension mounting shaft 112 and a locking ridge 114.

FIG. 2 and FIG. 6 depict an extension member 116 which is capable of being molded from a plastic and which is pivotally attachable to both protrusion member 84 and sliding member 62. Extension member 116 has a first pivotal portion 118 at one end, a second pivotal portion 120 at the opposing end and an extension portion 122 positioned therebetween. First pivotal portion 118 further comprises a first pivotal aperture 124. Second pivotal portion 120 further comprises a second pivotal aperture 126 and a snap channel 128 partially opening second pivotal aperture 126. First pivotal aperture 124 of extension member 116 is forced over locking ridge 114 of protrusion member 84 for retention relative to extension mounting shaft 112. This provides for a pivotal coupling between first pivotal portion 118 of extension member 116 and pivotal coupling portion 96 of protrusion member 84. Second pivotal aperture 126 of extension member 116 is forced over extension mounting shaft 86 of sliding member 62, utilizing snap channel 128. This provides for a pivotal coupling between second pivotal portion 120 of extension member 116 and pivotal coupling portion 68 of sliding member 62.

Thus, in this embodiment, each assembly 38, see FIG. 2, is formed of one (1) sliding member 62, one (1) protrusion member 84 and one (1) extension member 116 all connected together. In usage, each assembly 38 will be coupled to either another such assembly 38 or some other detached component relative to track member 36. This coupling would provide for resistance to displacement of assembly 38 along track member 36 and, viewed collectively, result in the desired operation of automatic deploying multi panel shower curtain 34.

FIG. 1, FIG. 2, FIG. 10 and FIG. 11 depict panels 40 in various orientations. As best shown in the top plan views, panel 40 preferably has an ogee, or "S", shape between a first vertical edge 130 and a second vertical edge 132. A central axis 134 of panel 40, see FIG. 10, generally aligns with rotational axis 74 of sliding member 62. Each panel 40 is capable of being molded, preferably by an extrusion process, from a plastic.

Figure 10:
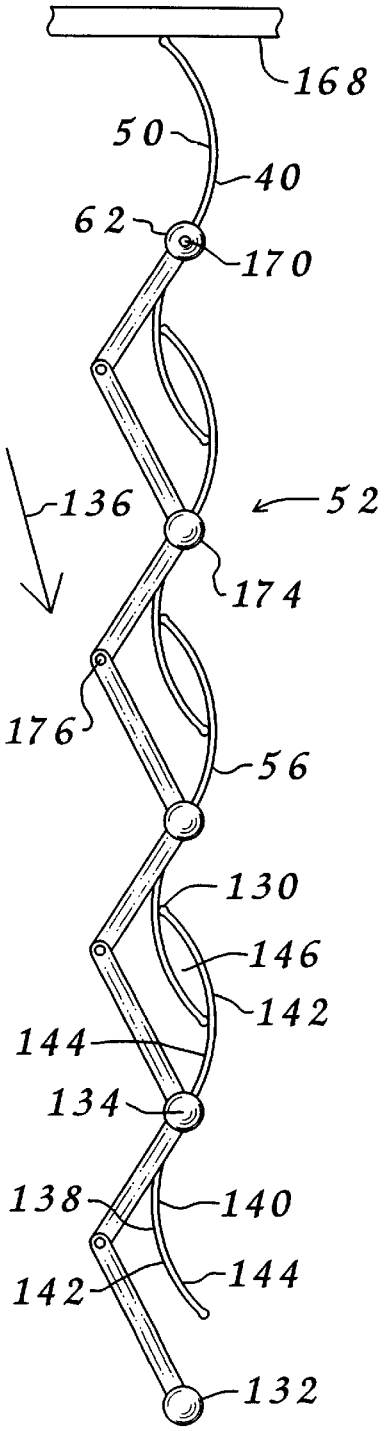
FIG. 10 is a top plan view of a portion of an automatic deploying multi panel shower curtain with each panel thereof in an extended, or water barrier, orientation with the track member removed.

In a deployment each automatic deploying multi panel shower curtain 34 will have a water flow direction 136, see FIG. 10, corresponding to a location of a shower head, not shown in any of the views. In practice it is a desire that each panel 40 overlap the subsequent panel 40 while moving along water flow direction 136. In order to reverse a directional orientation of automatic deploying multi panel shower curtain 34, to correspond to directional relationship of the shower head, each panel 40 may be mounted in a reverse orientation of upper extent 58 and lower extent 60.

Each panel 40 has a first side 138 and a second side 140, see FIG. 10. Preferably each side 138 and 140 has a convex surface 142 and a concave surface 144. Preferably convex surface 142 and concave surface 144 join in close proximity to central axis 134.

When in extended arrangement 52, as clearly depicted in FIG. 10, an overlapping contact between concave surface 144 of one (1) panel 40 with concave surface 144 of an adjacent panel 40 forms an enclosed area 146. This overlapping feature and enclosed area 146 provide for a water resistant barrier during a showering procedure wherein if a slight amount of water enters enclosed area 146 it simply runs down within enclosed area 146 and is dispensed back into the shower area.

Figure 11:
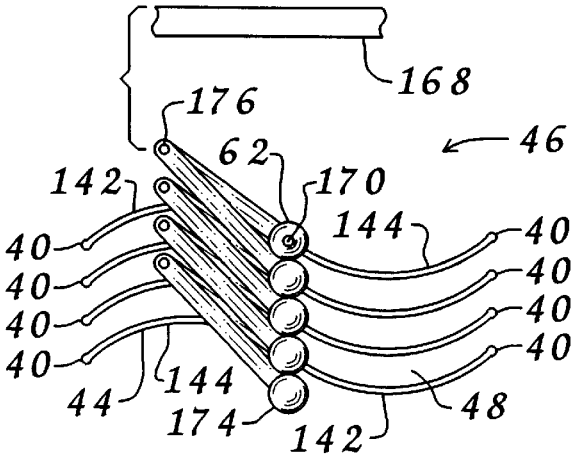
FIG. 11 is a top plan view of the components depicted in FIG. 10 with each panel thereof in a retracted, or drying, orientation.

When in retracted arrangement 46, as clearly depicted in FIG. 11, each convex surface 142 of each panel 40 mates with a respective concave surface 144 of an adjacent panel 40 while maintaining spacing 48 therebetween. This mating feature provides for adequate ventilation about automatic deploying multi panel shower curtain 34 to allow for a drying of all panels 40.

FIG. 2 and FIG. 7 depict spacer member 54 which is capable of being molded from a plastic. Spacer member 54 has a pair of spaced prongs 148 separated by a panel channel 150. Each prong 148 has at least one (1) panel locking ridge 152 extending into panel channel 150 respectively elevationally spaced. Each prong 62 has an adjacent panel contacting surface 154 which will contact an adjacent panel and prevent bonding contact between the adjacent panels while the panels are in drying orientation 44, see FIG. 11. This arrangement provides for ventilation between adjacent panels to ensure drying of the panels. In certain configurations it may be necessary to provide for a shaping of spacer member 54 to provide for passage of adjacent panels during displacement and particularly from barrier orientation 50, see FIG. 10, to drying orientation 44, see FIG. 11. Alternatively, modification may be made to applicable panels at lower extent 60, see FIG. 2, as exampled by a corner 156 which provides for passage of panel 40 by spacer member 54.

Figure 9:
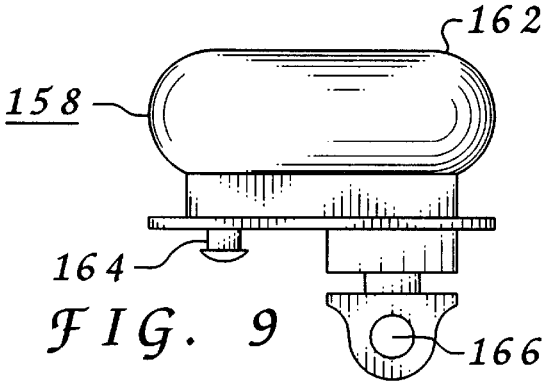
FIG. 9 is an elevational view of the control rod sliding member depicted in FIG. 4.

FIG. 4 and FIG. 9 depict a control rod sliding member 158 which is capable of being molded from a plastic. Control rod sliding member 158 slidably engages track member 36, see FIG. 1 and FIG. 2, Control rod sliding member 158 provides for coupling thereto of one (1) outermost assembly 38 and a draw rod 160, see FIG. 1. Draw rod 160 provides for manipulation of automatic deploying multi panel shower curtain 34 by a user, not shown in any of the various views. Control rod sliding member 158 has a track engaging member 162, a pivotal coupling 164 and a draw rod mounting aperture 166. Track engaging member 162 preferably is elongated to provide for a fixed, non rotationally, movement within track member 36. Pivotal coupling 164 provides for engagement of first pivotal aperture 124 of extension portion 122, see FIG. 6. Draw rod mounting aperture 166 provides for pivotal coupling of draw rod 160, see FIG. 1.

Operation

Certain configurations of assemblies and panels may provide for full transfer of each respective panel from it's drying orientation to its's barrier orientation without effecting the subsequent panel to be transferred. Similarly, certain configurations of assemblies and panels may provide for full transfer of each respective panel from it's barrier orientation to it's drying orientation without effecting the subsequent panel to be transferred. While this may be desired in select deployments, certain configurations, as depicted in the various views, provide for a beginning of transfer of subsequent panels during transfer of each respective panel. This arrangement provides for smooth operation of the automatic deploying multi panel shower curtain during both directional displacements.

Certain configurations of assemblies and panels may provide for elimination of possible over rotation of each respective panel beyond that rotation required for placement within a respective barrier orientation or a respective drying orientation. This may be accomplished by providing for impaction of an adjacent detached member, as depicted within the various views, or by providing structures on each assembly which physically prevent such over rotation.

FIG. 10 and FIG. 11 depict an orientation of four (4) panels 40 in barrier orientation 50 and drying orientation 44 respectively along with associated components positioned adjacent a wall 168. Track member 36, see FIG. 1, has been removed in FIG. 10 and FIG. 11 to more fully depict the various components positioned therebeneath. Ideally, panel 40 and the corresponding sliding member 62 closest to wall 168 is restricted relative to the track member for stationary rotation within the track member. Numerous structural configurations may be employed to provide for this restriction. In a preferred embodiment a hole 170 partially penetrates the applicable sliding member 62, also see FIG. 8, for reception of a pin 172 through an aperture in track member 36, see FIG. 1. This arrangement provides for adequate spacing of the panels 40 from wall 168 while in retracted arrangement 46, see FIG. 11 while providing for contact with wall 168 while in extended arrangement 52, see FIG. 10.

Referring now to FIG. 2, FIG. 10 and FIG. 11. A series of first pivotal connections 174 each provide for a pivotal connection which occurs in close proximity to the vertical axis of a respective panel 40. A series of second pivotal connections 176 each provide for a pivotal connection which occurs offset from the vertical axis of a respective panel 40. Cooperation means between respective cooperating sets of sliding member 62, first pivotal connection 174 and second pivotal connection 176 provides for a cooperation to provide for transfer of the automatic deploying multi panel shower curtain between the barrier orientation 50 and the drying orientation 44.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic deploying multi panel shower curtain having an water resistant barrier orientation and a ventilated drying orientation, the automatic deploying multi panel shower curtain comprising:

a) a track member to provide for a sliding retention of moveable portions of the automatic deploying multi panel shower curtain;

b) a plurality of panel connectors, each panel connector slidably engaging the track member, each panel connector having a vertical axis relative to the track member;

c) a plurality of panels to provide for forming the water resistant barrier orientation while deployed in an extended position along the track member and to provide for forming the ventilated drying orientation while deployed in a retracted position along the track member, each panel hangedly connected to a respective panel connector;

d) a plurality of first pivotal connections, each first pivotal connection to provide for a pivotal connection, the pivotal connection of the first pivotal connection occurring in close proximity to the vertical axis of a respective retained panel;

e) a plurality of second pivotal connections, each second pivotal connection to provide for a pivotal connection, the pivotal connection of the second pivotal connection occurring offset from the vertical axis of a respective retained panel;

f) cooperation means to provide for a cooperation between respective cooperating sets of sliding member, first pivotal connection and second pivotal connection, the cooperation to provide for transfer of the automatic deploying multi panel shower curtain between the barrier orientation and the drying orientation.

2. The automatic deploying multi panel shower curtain defined in claim 1 wherein each of the hanging panels further comprises a longitudinal length and wherein each of the hanging panels further comprises an ogee cross sectional shape perpendicular to the longitudinal length.

3. The automatic deploying multi panel shower curtain defined in claim 1 further comprising a plurality of spacers, each spacer attachable to a lower extent of a respective panel wherein each adjacent set of panels are separated while in the ventilated orientation.

4. A guide assembly to provide for an attachment of a plurality of panels relative to a track member, the guide assembly, the plurality of panels and the track member cooperating to form a multi paneled shower curtain, the guide assembly comprising:

a) a plurality of sliding members, each sliding member comprising:

1) a track member engaging portion to provide for a sliding engagement of the track member;

2) a panel coupling portion to provide for securing one of the panels to the sliding member;

3) a protrusion mounting channel;

4) a pivotal coupling portion;

b) a plurality of protrusion members, each protrusion member comprising:

1) a fixed coupling portion to provide for an attachment of a respective first coupling member to a respective sliding member at the protrusion mounting channel of the respective sliding member;

2) a pivotal coupling portion positioned distal from the fixed coupling portion;

c) a plurality of extension members, each extension member comprising:

1) a first pivotal coupling portion to provide for a pivotal attachment of a respective second coupling member to a respective first coupling member at the pivotal coupling portion of the respective first coupling member;

2) a second pivotal coupling portion positioned distal from the first pivotal coupling portion, the second pivotal coupling portion to provide for a pivotal attachment of a respective sliding member at the pivotal coupling portion of the respective sliding member.

5. The guide assembly defined in claim 4 wherein each of the hanging panels further comprises a longitudinal length and wherein each of the hanging panels further comprises an ogee cross sectional shape perpendicular to the longitudinal length.

6. The guide assembly defined in claim 4 further comprising a plurality of spacers, each spacer attachable to a lower extent of a respective panel wherein each adjacent set of panels are separated while in the ventilated orientation.

7. The guide assembly defined in claim 4 wherein:

a) each of the protrusion members has a spacing between a rotational axis of the sliding member and the pivotal coupling portion; and b) each of the extension members has a spacing between the first pivotal coupling portion and the second pivotal coupling member, and wherein the spacing of the protrusion members is unique from the spacing of the extension members.

8. The guide assembly defined in claim 4 wherein each fixed coupling portion of the protrusion member penetrates the protrusion mounting channel of a respective sliding member.

9. The guide assembly defined in claim 4 wherein each second pivotal coupling portion of the extension member radially surrounds the pivotal coupling portion of a respective sliding member.

* * * * *